US010696452B2

(12) United States Patent
Werner et al.

(10) Patent No.: US 10,696,452 B2
(45) Date of Patent: Jun. 30, 2020

(54) SELF ALIGNING CAN STACKING RING

(71) Applicants: Christopher Werner, Calabasas, CA (US); Dawnn Winter, Marina del Rey, CA (US); Norman Levine, Calabasas, CA (US)

(72) Inventors: Christopher Werner, Calabasas, CA (US); Dawnn Winter, Marina del Rey, CA (US); Norman Levine, Calabasas, CA (US)

( * ) Notice: Subject to any disclaimer, the term of this patent is extended or adjusted under 35 U.S.C. 154(b) by 81 days.

(21) Appl. No.: 15/866,263

(22) Filed: Jan. 9, 2018

(65) Prior Publication Data

US 2019/0210766 A1 Jul. 11, 2019

(51) Int. Cl.

| | |
|---|---|
| ***B65D 21/02*** | (2006.01) |
| ***B65D 71/70*** | (2006.01) |
| *B44D 3/12* | (2006.01) |

(52) U.S. Cl.

CPC ..... *B65D 21/0224* (2013.01); *B65D 71/70* (2013.01); *B44D 3/127* (2013.01)

(58) Field of Classification Search

CPC .... B65D 21/00–0224; B65D 71/00–70; B65D 2543/00435; B65D 2543/0074; B44D 3/00–127

See application file for complete search history.

(56) References Cited

U.S. PATENT DOCUMENTS

| | | | | | |
|---|---|---|---|---|---|
| 1,696,240 | A | * | 12/1928 | Kircher | B44D 3/128 220/797 |
| 2,899,096 | A | | 8/1959 | Henchert et al. | |
| 3,173,574 | A | | 3/1965 | Goldsmith | |
| 3,180,537 | A | | 4/1965 | Collins | |
| 3,228,857 | A | | 1/1966 | McCormick | |
| 3,273,746 | A | * | 9/1966 | Andrews, Jr. | B44D 3/128 220/698 |
| 3,354,515 | A | | 11/1967 | Robinson | |
| 3,463,366 | A | * | 8/1969 | Spencer | B65D 25/48 222/570 |
| 3,469,735 | A | * | 9/1969 | Burt | B65D 25/50 220/698 |
| 3,744,671 | A | * | 7/1973 | Saunders, Jr. | B65D 25/20 220/698 |
| 3,811,606 | A | * | 5/1974 | Higgins | B44D 3/128 222/570 |
| 4,111,330 | A | | 9/1978 | Jordan | |
| 4,728,003 | A | | 3/1988 | Davey | |
| 4,932,554 | A | | 6/1990 | Smith et al. | |
| 5,160,067 | A | * | 11/1992 | Luber | B65D 43/0218 220/698 |
| 5,161,689 | A | | 11/1992 | Balson | |
| 5,174,464 | A | | 12/1992 | Watt | |
| 5,193,705 | A | | 3/1993 | McCallum et al. | |
| 5,261,551 | A | | 11/1993 | Watt | |

(Continued)

*Primary Examiner* — Kareen K Thomas
(74) *Attorney, Agent, or Firm* — Kenneth L. Green; Averill & Green

(57) ABSTRACT

A self aligning stacking ring guides stacked cans into alignment. The self aligning stacking ring includes radially protruding alignment bumps angularly spaced apart at a common radius corresponding to a recess in the bottom of common cans. The self aligning stacking ring guides tend to center a can placed over the self aligning stacking ring guides to make stacking cans easier and quicker.

10 Claims, 2 Drawing Sheets

(56) References Cited

U.S. PATENT DOCUMENTS

| | | | | | |
|---|---|---|---|---|---|
| 5,568,879 | A | * | 10/1996 | Kovathana | B44D 3/128 220/697 |
| 5,636,753 | A | | 6/1997 | Wilkinson et al. | |
| 5,779,093 | A | * | 7/1998 | Poole | B44D 3/128 220/698 |
| 5,803,298 | A | | 9/1998 | Hausmann | |
| 5,915,557 | A | | 6/1999 | Levine | |
| 5,967,363 | A | * | 10/1999 | Allen | B44D 3/128 220/701 |
| 6,142,330 | A | | 11/2000 | Sacks | |
| 6,189,725 | B1 | * | 2/2001 | Monico | B44D 3/128 220/698 |
| 6,612,439 | B1 | | 9/2003 | Levine | |
| 6,688,487 | B2 | * | 2/2004 | Oakes | B65D 43/021 215/318 |
| 7,617,946 | B2 | | 11/2009 | Loerop et al. | |
| 8,286,820 | B2 | * | 10/2012 | Williams | F16J 13/14 220/367.1 |
| 2004/0232150 | A1 | | 11/2004 | John P. et al. | |

* cited by examiner

SELF ALIGNING CAN STACKING RING

BACKGROUND OF THE INVENTION

The present invention relates to stacking cylindrical containers and in particular to a stacking ring.

One gallon cans, for example paint cans, are sold and shipped in huge numbers. The cans are generally stacked several cans high in several rows and columns. Stacking rings are commonly attached to the tops of the cans to stabilize the stacks of cans. A recess in the bottom of the cans must be manually aligned to correctly engage the stacking rings. Any irregularities in the recess may make it difficult to correctly engage the bottom recess with the alignment rings, and the stacked cans may move sufficiently to lose stability and fall, potentially damaging the cans, releasing liquid in the cans. Proper alignment of the cans may be difficult and require additional time increasing shipping costs.

BRIEF SUMMARY OF THE INVENTION

The present invention addresses the above and other needs by providing a self aligning stacking ring guides stacked cans into alignment. The self aligning stacking ring includes radially protruding alignment bumps angularly spaced apart at a common radius corresponding to a recess in the bottom of common cans. The self aligning stacking ring guides tend to center a can placed over the self aligning stacking ring guides to make stacking cans easier and quicker.

In accordance with one aspect of the invention, there is provided a self aligning stacking ring including angularly spaced part radially expending bumps to guide a can into alignment. Known alignment rings include arc segments with uniformly arced outer radii. A top can must be precisely positioned over the known alignment ring to engage the alignment ring. If the cans are not properly aligned to engage the alignment ring, the stack of cans may not be stable, and may result is the cans falling and being damaged. The bumps provide easier alignment without sacrificing a precise alignment.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement.

Figure 1:
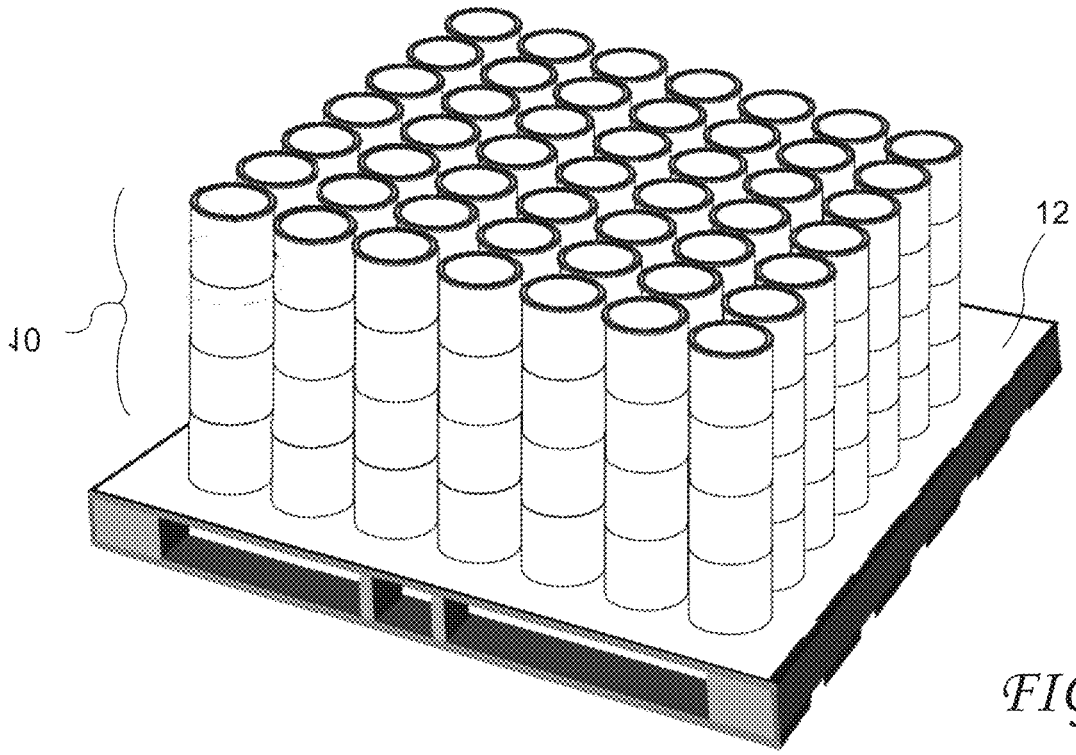
FIG. 1 shows cans stacked on a pallet, aligned by alignment rings according to the present invention.

Cans 10 stacked on a pallet 12 are shown in FIG. 1. The cans 10 are aligned by alignment rings 14 according to the present invention. The cans 10 are commonly one gallon cans stacked four high in seven by seven layers, for a total of 196 cans. A full pallet of 196 one gallon cans 10 containing liquid having about the weight of water (i.e., about 8.35 pounds per gallon) weighs about 1,637 pounds. It is therefore important the full pallet be stable. Alignment rings 14 provide the important role of maintaining that stability.

Figure 2:
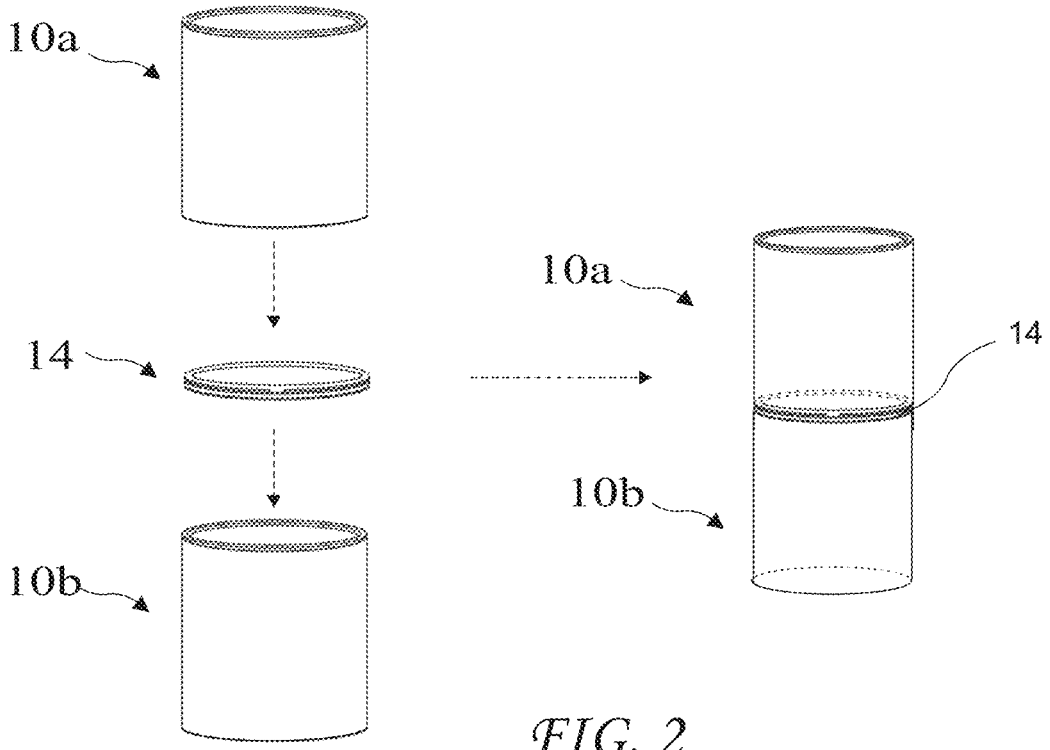
FIG. 2 the cans separated, and then stacked and alig ned by the alignment rings according to the present invention.

Two of the cans 10 separated, and then stacked and aligned by the alignment ring 14, are shown in FIG. 2. The alignment ring 14 attaches to a bottom can 10*b* and aligns a top can 10*a* to the bottom can 10*b*.

Figure 3:
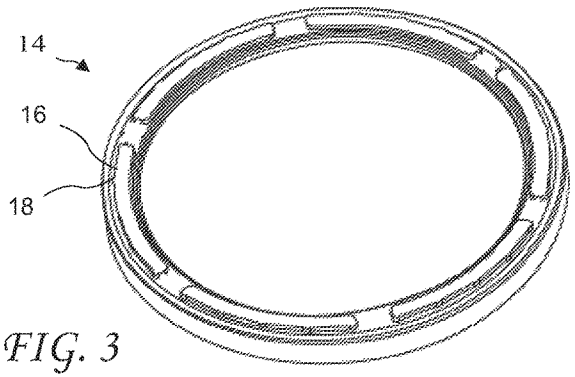
FIG. 3 shows an isometric view of the alignment ring according to the present invention.
Figure 5:
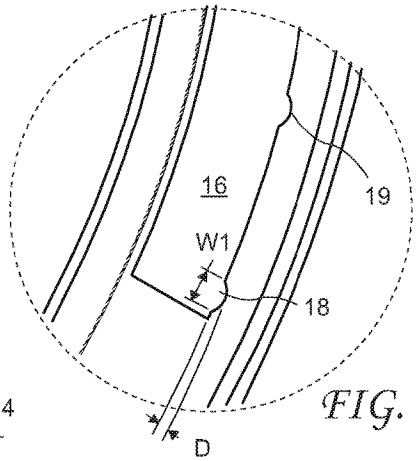
FIG. 5 shows detail 5 of FIG. 4B.
Figure 4B:
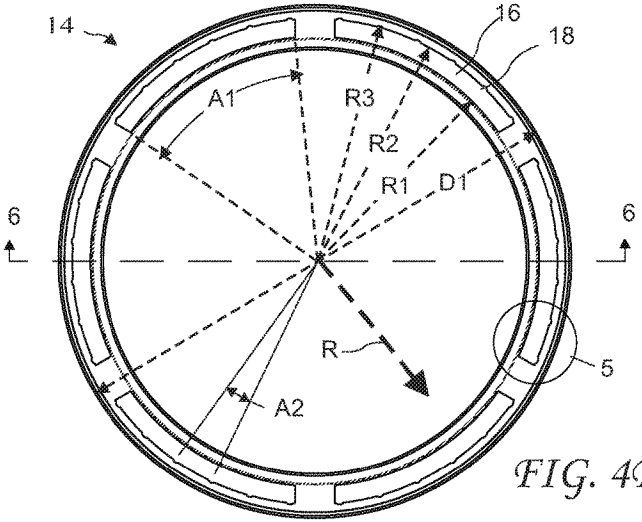
FIG. 4B shows a top view of the alignment ring according to the present invention.
Figure 4A:
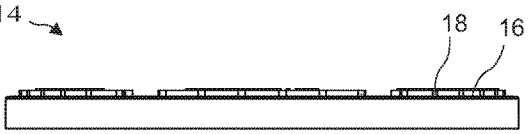
FIG. 4A shows a side view of the alignment ring according to the present invention.
Figure 6:
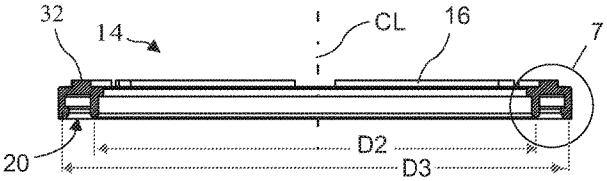
FIG. 6 shows a cross-sectional view of the alignment ring according to the present invention taken along line 6-6 of FIG. 4B.

An isometric view of the alignment ring 14 is shown in FIG. 3, a side view of the alignment ring 14 is shown in FIG. 4A, a top view of the alignment ring 14 is shown in FIG. 4B, and a cross-sectional view of the alignment ring 14 taken along line 6-6 of FIG. 4B is shown in FIG. 6. The alignment ring 14 has a round body 15 having a radial dimension R and an overall diameter D of about 6.8 inches and includes raised arcs 16 and angularly spaced apart bumps 18 extending radially from the raised arcs 16 to radial peaks 19. The raised arcs 16 have an inside radius R1 of about 0.3 inches and an outside radius R2 of about 3.105 inches, extend angularly and angle A1 of about 50 degrees, and have a height H4 of about 0.085 inches. The bumps 18 extend radially to a radius R3 of about 3.1635 inches, or about 0.0575 inches past the raised arcs 16 and are preferably angularly spaced apart an angle A2 of about ten degrees. The bumps 18 preferably have a flat top and a generally round horizontal profile and form about a 115 degree arc. The bumps 18 are preferably angularly spaced about ten degrees apart. The bumps 18 will align with the recesses in the bottom of the can 10*a* even when the recess is not perfectly round, making alignment easier. The bumps 18 preferably reach a radius R3 of preferably about 3.24 inches or reach a radial distance D of about 0.04 inches past the raised arcs 16 and a width W1 of about 0.1 inches.

Figure 7:
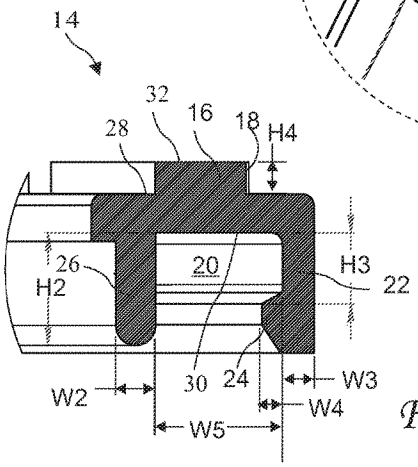
FIG. 7 shows detail 7 of FIG. 6.

A cross-sectional view of the alignment ring 14 taken along line 6-6 of FIG. 4B is shown in FIG. 6 and FIG. 7 shows detail 7 of FIG. 6. The alignment ring 14 includes an attachment groove 20 for attaching to the can 10B (see FIG. 2). The attachment groove 20 includes an outer wall 22, and inner wall 26, and a convex lip 24 reaching in from the base of the outer wall 22. Inner wall 26 is preferably centered at a diameter D2 of about 5.854 inches and the outer wall 22 is preferably centered at a groove width of about 0.334 inches, and a diameter D3 of about 6.715 inches. The inner ring 26 has a height H2 of about 0.3 inches and width W2 of about 0.1 inches. The outer ring 22 has an intermediate heights H3 of about 0.19 inches, and straight leg width W3 of about 0.085 inches, a convex lip 24 width W4 of about 0.055 inches. The alignment ring 14 includes a vertical centerline CL. The alignment ring 14 further includes a top surface 28, a bottom surface 20, and the raised arcs 16 include flat tops 32.

The alignment ring is preferably made from plastic, and more preferably from High Density Polyethylene (HDPE).

While the invention herein disclosed has been described by means of specific embodiments and applications thereof, numerous modifications and variations could be made thereto by those skilled in the art without departing from the scope of the invention set forth in the claims.

We claim:

1. A stacking ring comprising:

a round body forming a ring and having a bottom surface configured to face a can below the stacking ring and a top surface above the bottom surface;

an engagement groove under the bottom surface of the body configured to engage a can top of the can below the stacking ring;

raised arcs residing on the top surface of the body;

angularly spaced apart raised bumps on the top surface reaching radially out from the raised arcs, the raised bumps reaching out to a common radius from a vertical centerline of the body, wherein:

the raise arcs have a height above the top surface of the body of 0.085 inches; and the bumps have a same height as the raise arcs.

2. The stacking ring of claim 1, wherein the raised arcs have flat tops, and the bumps continue the flat tops.

3. The stacking ring of claim 1, wherein the raised arcs comprise six raised arcs.

4. The stacking ring of claim 1, wherein the bumps are angularly spaced apart ten degrees.

5. The stacking ring of claim 1, wherein the bumps reach out radially 0.04 inches past the raised arcs.

6. The stacking ring of claim 1, wherein the bumps have a round outer profile.

7. The stacking ring of claim 1, wherein the bumps are spaced apart 10 degrees.

8. The stacking ring of claim 1, wherein the bumps reach out radially to a radius of 3.24 inches.

9. The stacking ring of claim 1, wherein the engagement groove has a depth of 0.3 inches and a width of 0.334 inches.

10. A stacking ring comprising:

a round body forming a ring and having a bottom and a top surface;

an engagement groove in the bottom of the body configured to engage a can top;

six angularly spaced apart raised arcs on the top surface of the body, the raised arcs extending 50 degrees and separated by angular gaps of ten degrees and have a height of 0.085 inches; and 36 angularly spaced apart bumps extending radially from the raised arcs, having a same height as the raised arcs and extending radially 0.04 inches past the raised arcs.

* * * * *